US007946889B2

(12) United States Patent
Mizumura

(10) Patent No.: US 7,946,889 B2
(45) Date of Patent: May 24, 2011

(54) EDGE CONNECTOR WITH PRELOAD CAPS

(75) Inventor: Akinori Mizumura, Kanagawa (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/514,706

(22) PCT Filed: Nov. 15, 2007

(86) PCT No.: PCT/US2007/024024

§ 371 (c)(1),
(2), (4) Date: Oct. 6, 2009

(87) PCT Pub. No.: WO2008/066714

PCT Pub. Date: Jun. 5, 2008

(65) Prior Publication Data

US 2010/0015835 A1 Jan. 21, 2010

(30) Foreign Application Priority Data

Nov. 15, 2006 (JP) ..... 2006-308934

(51) Int. Cl.
*H01R 9/05* (2006.01)

(52) U.S. Cl. ..... 439/637; 439/62

(58) Field of Classification Search ..... 439/637, 439/62

See application file for complete search history.

(56) References Cited

U.S. PATENT DOCUMENTS 3,671,917 A * 6/1972 Ammon et al. ..... 439/62
5,997,312 A * 12/1999 Ho et al. ..... 439/60
6,210,177 B1 * 4/2001 Huang et al. ..... 439/74
2004/0005816 A1 1/2004 Sato et al.

FOREIGN PATENT DOCUMENTS

| | | |
|---|---|---|
| EP | 1432079 | 6/2004 |
| GB | 2242579 | 10/1991 |
| JP | 04126383 | 4/1992 |

OTHER PUBLICATIONS

International Search Report and Written Opinion for PCT/US2007/0024024.

* cited by examiner

*Primary Examiner* — Gary F. Paumen
(74) *Attorney, Agent, or Firm* — Timothy M. Morella

(57) ABSTRACT

A circuit board edge connector includes an insulative housing and two opposing mating ends with a plurality of conductive terminals supported by the housing and extending between the two ends. One end of the connector mates with an opposing connector and the other end has a slot disposed therein that receives the mating edge of a printed circuit card or board. The terminals at the end of the connector extend outwardly in a cantilevered fashion and they terminate in free ends that contact conductive pads on the edge of the circuit card. A preload cap is provided that includes two parts that interfit with each other and with the circuit card mating end of the connector. These preload caps engage the terminal free ends and impart a preload to the terminals so that the circuit card may be easily inserted into the connector slot and the caps are subsequently removed from the connector.

8 Claims, 10 Drawing Sheets

EDGE CONNECTOR WITH PRELOAD CAPS

BACKGROUND OF THE INVENTION

The present invention relates to an edge connector, and more particularly to an edge connector which utilizes a preload cap in order to spread out the contact portions of the terminals prior to mating with an edge card.

Conventionally, an edge connector is used as a direct type connector in which an edge, of a substrate such as a printed circuit board is directly inserted and fitted into connector, as a plug portion as shown in Japanese Patent Application Laid-Open (Kokai) No. H4-126383.

FIG. 14 is a perspective view of sudl a conventional edge connector.

As illustrated in FIG. 14, the connector has a housing 801 made of an insulating material and includes a plurality of conductive terminals 802 that are held in the housing 801. Contact portions 803 of the terminals 802 project downward from a lower surface of the housing 801. 810 designates a substrate such as a printed circuit board or the like having a plurality of pads 811 arranged along and where "t" designates the thickness of the substrate 810.

In this case, an angled hole 804 is formed in the center portion of the housing 801, and the hole 804 extends in the direction of the terminals 802 and passes through the housing 801 in the thickness direction. A spacer 805 with a thickness "w" larger than the thickness "t" of the substrate 810 is inserted from above into the angled hole 804, and the tip of the spacer 805 projects from the lower surface of the housing 801 between the contact portions 803 of the terminals 802 on both sides. The opposing contact portions 803 are forcibly spread by the tip of the spacer 805, and the distance between the opposing contact portions 803 is equal to or greater than "w", which is greater than the thickness "t" of the substrate 810.

As illustrated, the substrate 810 is inserted between the contact portions 803 so that the state in which the contact portions 803 are forcibly spread by the spacer 805. In this case, the distance between the opposing contact portions 803 is larger than the thickness "t" of the substrate 810, the contact portions 803 may not buckle or deformed due to the contact by the inserted substrate 810. The spacer 805 is pushed up by the substrate 810 and the contact portions 803 become deformed so that the distance between them is reduced by the spring force of the contact portions 803 and sandwich the substrate 810 from both sides. Thus, the edge connector is fixed to the substrate 810. In addition, the contact portions 803 are pressed against the connecting electrodes 811 by the spring force that the contact portions 803 have and are reliably electrically connected thereto.

SUMMARY OF THE INVENTION

However, in the above-described conventional edge connector, since the contact portions 803 of the terminals 802 are held in the state of being forcibly spread by the spacer 805, it is difficult to apply a preload pressure to the contact portions 803 in advance. In other words, since the spacer 805 has thickness "w" which is greater than the substrate thickness "t", the distance between the contact portions 803 becomes larger than the thickness "t" of the substrate 810. For this reason, for instance, when the edge connector is stored in inventory the contact portions 803 are held for a long time and are forcibly spread, a creep or elastic deformation occurs and the contact portions 803 may not be able to return to the original shape, resulting in not being able to sandwich the substrate 810 from both sides with a sufficient force. As a result, the electrical connection between the contact portions 803 and the substrate 810 is more likely to become uncertain.

Furthermore, in the case of inserting the substrate 810, since the contact portions 803 do not contact the connecting electrodes 811 until the spacer 805 is released from between the contact portions 803, the wiping effect occurring when the contact portions 803 contact the moving connecting electrodes 811, that is, the effect of removing the dust, foreign matters, or the like of the connecting electrodes 811 by rubbing them by the contact portions 803 may not be exerted. As a result, the connection between the contact portions 803 and the pods 811 of the substrate 810 becomes uncertain.

An object of the present invention is to solve the above-described problem and to provide an edge connector with a removably attached preload cap for holding terminals such that the distance between the contact portions of the opposing terminals are set to be slightly narrower than the thickness of the substrate to be inserted, thereby the preload given to the terminals may be maintained at an appropriate level, and a creep deformation may not occur in the terminals even when the edge connector is left to stand for a long period of time, whereby the terminals may fully exert their force, sandwich and hold the contact electrodes of the substrate, insertion work of the substrate may be easily performed because the resistance received from the terminals during the insertion work is decreased, a deformation and damage to the terminals may not occur, the electrical connection state of the contact portions of the terminals and the contact electrodes are favorable due to the wiping effect, and with high durability.

For solving this object, an edge connector of the present invention comprises a connector body for engaging with a counterpart connector; terminals extending from the connector body, the terminals including contact portions for contacting electrodes disposed on surfaces of a substrate; the connector body including a mounting part for attaching a removable preload cap; the contact portions being arranged in opposing rows where a distance between the opposing contact portions in an initial state is smaller than a thickness of the substrate, the distance in a state where the preload cap is attached being larger than that of the initial state and smaller than the thickness of the substrate.

In a further aspect of the present invention, the contact portion includes an engaging portion at a tip thereof the preload cap includes a terminal holding portion and the engaging portion is engaged with the terminal holding portion in the state in which the preload cap is attached.

In a still further aspect of the present invention, the preload cap comprises a first preload cap corresponding to one of the rows of the contact portions and a second preload cap corresponding to the other row of the contact portions and the first preload cap and the second preload cap have an identical structure to each other, and are attached to the connector housing so that they face each other.

In a still further aspect of the present invention, an amount of extension of the preload cap attached to the connector body from the connector body is longer than an amount of extension of the contact portion from the connector body.

In the connector according to still further aspect of the present invention, the cap mounting part has a concave portion formed in the connector body outside the mutually opposing rows of the contact portions and the preload cap further includes a fitting projection that is inserted in the cap mounting part.

In the connector according to still further aspect of the present invention, the preload cap forms a substrate insertion opening into which the substrate can be inserted in the state in which the preload cap is attached to the connector body, and the preload cap can then be removed from the connector often when the substrate is inserted in the substrate insertion opening and the distance between the opposing contact portions is spread by insertion of the substrate.

According to the present invention the preload cap for holding the terminals is removably attached so that the distance between the contact portions of the terminals is slightly narrower than the thickness of the inserted substrate. The preload given to the terminals may be maintained at an appropriate level, and creep deformation will not occur in the terminals even when the edge connector is left to stand for a long period of time. Hence, the terminals will fully exert their force and hold the contact electrodes of the substrate and the work of inserting the substrate is easily performed because the resistance received from the terminals during insertion is decreased, and deformation and damage to the terminals does not occur. The connection state of the contact portions and the contact electrodes is favorable due to the wiping effect, and the durability is improved.

DESCRIPTION OF THE PREFERRED EMBODIMENTS

Figure 1:
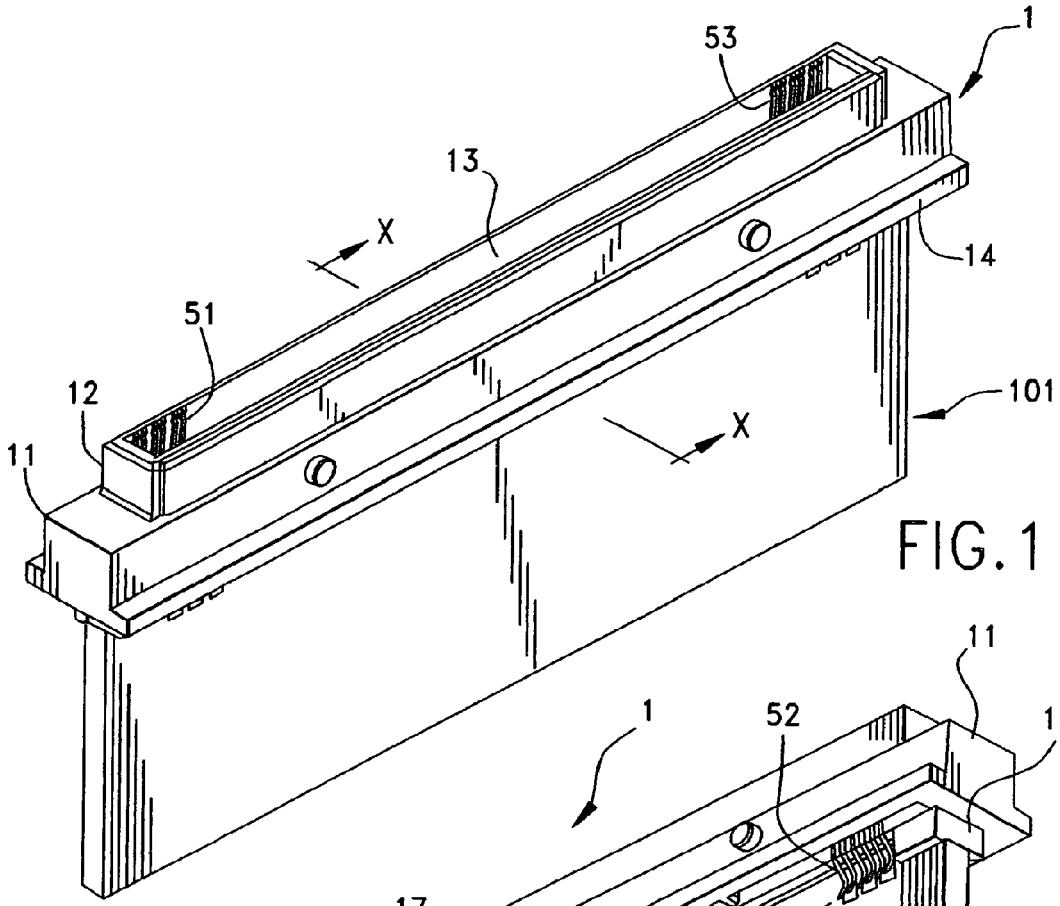
FIG. 1 is a first perspective view illustrating an edge connector according to an embodiment of the present invention in a state in which the edge connector is mounted on a substrate.

Reference numeral 1 designates an edge connector of the present invention, in which an edge portion of a substrate 101 is inserted therein. The substrate 101 is a printed circuit board used in an electronic device such as a computer, or the like, or a flat cable referred to as a flexible printed circuit (FPC), a flexible flat cable (FPC), or the like. In this embodiment, the present invention is explained in terms of the substrate 101 being a printed circuit board. The substrate 101 has a plurality of connecting electrodes or pods 151 arranged at a predetermined pitch on opposite surfaces thereof along the upper edge portion. The pods 151 are connected to conductive traces (not shown) of the substrate 101. The pitch and the number of the connecting electrodes 151 can be appropriately set.

The connector 1 includes a housing 11 serving as a connector body and made of an insulating material. A plurality of terminals 51 made of conductive metal are fitted in the housing 11. The housing 11 is an elongated member extending along the edge portion of the substrate 101 and having a rectangular cross-section. It includes a fitting portion 12 integrally formed therewith so as to extend on the opposite side (upper side in the Figure) of the substrate 101. The fitting portion 12 is a portion that mates to a counterpart or mating connector 201, and includes a concave portion 13 in which a convex portion 212 of the mating connector 201 is fitted. The concave portion 13 is an elongated groove-like portion having a rectangular cross-section which is open in the surface opposite to the substrate 101.

Figure 4:
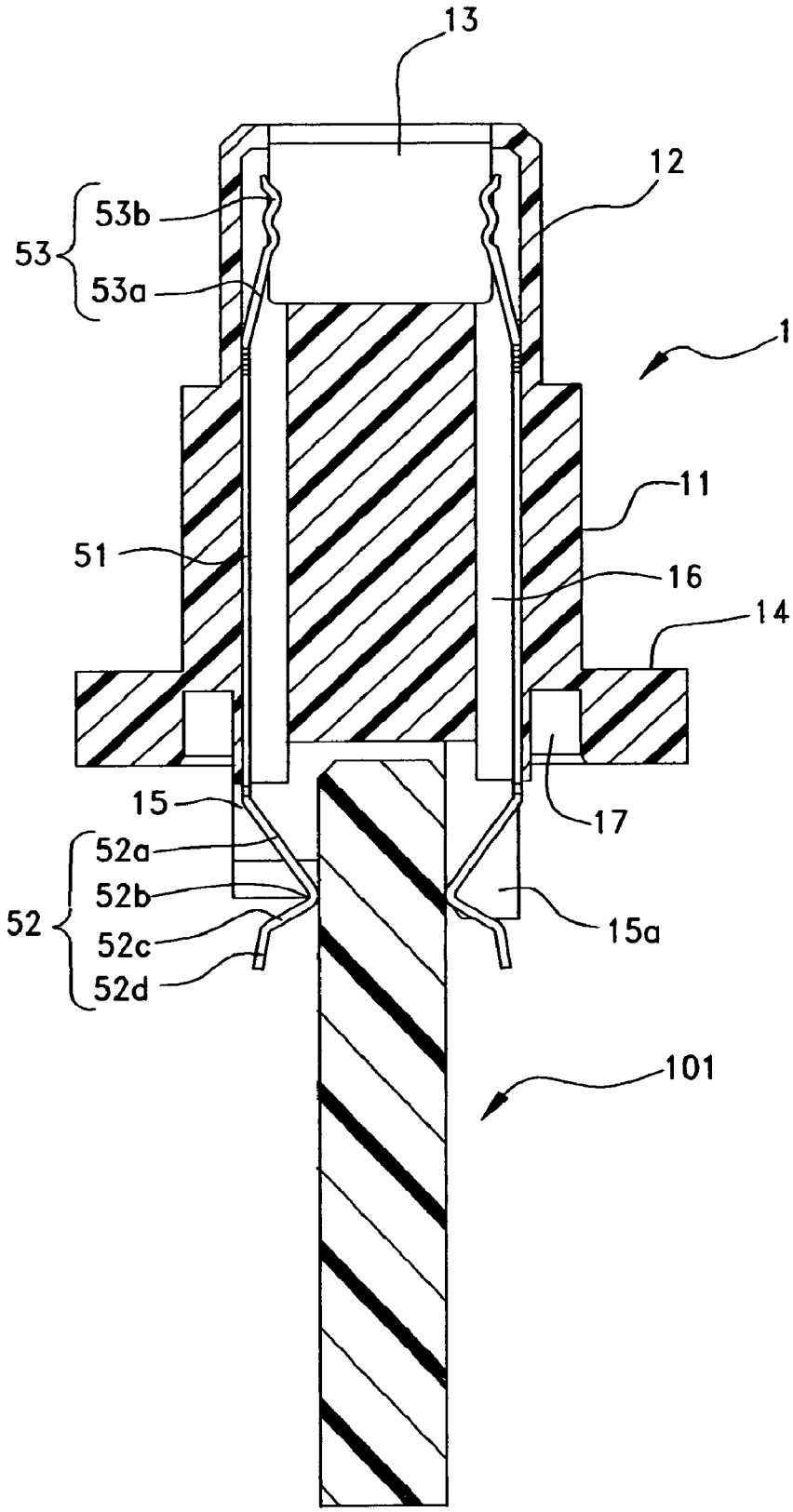
FIG. 4 is a cross-sectional view taken along line x-x of FIG. 2, and illustrating the edge connector is mounted on the substrate.

The terminals 51 are arranged along the inner wall surface of the concave portion 13. As illustrated in FIG. 4, terminal receiving grooves 16 extend through the housing 11 and the portion 12 with, each terminal 51 being accommodated in a single terminal receiving groove 16. The pitch and the number of the terminal receiving grooves 16 may be changed according to the pitch and the number of the contact pods 151 of the substrate 101. The terminals 51 need not necessarily be fitted in all of the terminal receiving grooves 16 and the terminals 51 can be omitted according to the arrangement of the contact pods 151 of the substrate 101.

Figure 3:
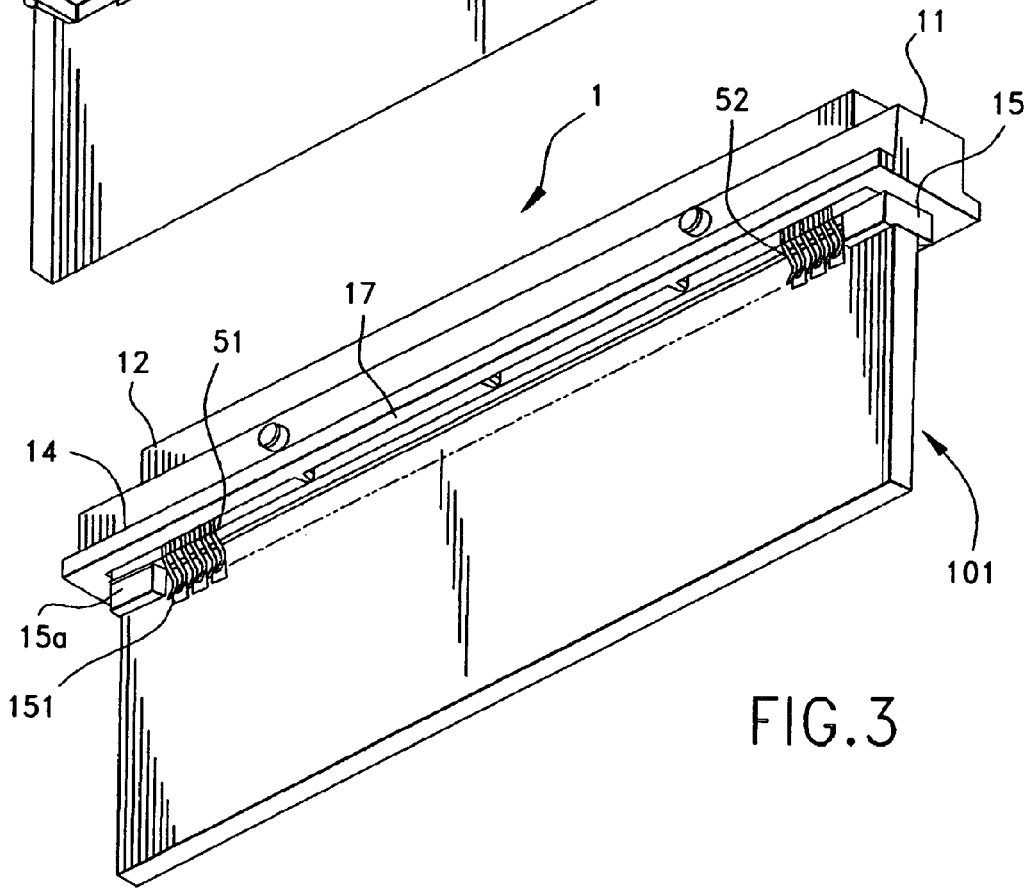
FIG. 3 is a similar view to FIG. 2.
Figure 2:
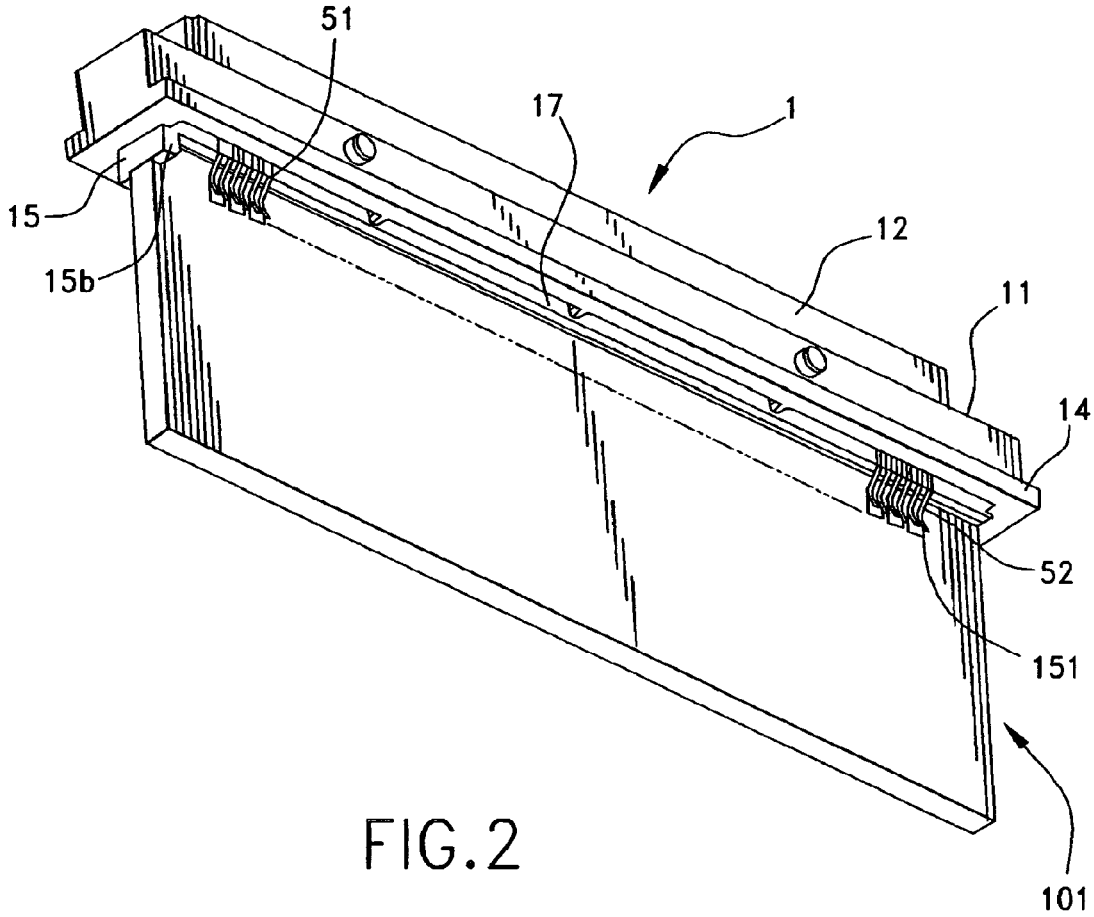
FIG. 2 is the same view as FIG. 1, but illustrating the edge connector mounted to the substrate.

For the sake of illustration, FIGS. 1-3 illustrate only some of the terminals 51 and contact pods 151 which are positioned on both sides of the substrate 101 in the widthwise direction.

The housing 11 includes flange parts 14 integrally formed therewith that extend outward from both ends of the housing 11 on one side of the substrate 101 (lower side in the Figure) and in the longitudinal direction of the housing 11, as well as guide parts 15 integrally formed therewith and arranged at the end surface of the housing 11 on the side of the substrate 101 in the vicinity of the ends in the longitudinal direction and extend toward the substrate 101. The guide parts 15 are members that define the positional relationship between the ends of the substrate 101 (right and left ends in FIGS. 1-3) and the housing 11, and contact both ends of the substrate 101. In addition, each guide parts 15 includes a first extension portion 15*a* and a second extension portion 15*b* integrally formed therewith so as to extend in the longitudinal direction of the housing 11. As illustrated in FIGS. 2-3, the extent of the first extension portion 15*a* is larger than the amount of extension of the second extension portion 15*b*. However, the extents of the first extension portion 15*a* and the second extension portion 15*b* may be appropriately changed. The first extension portion 15*a* and the second extension portion 15*b* contact opposite surfaces of the edge of the substrate 101 near the ends thereof and define the positional relationship of the substrate 101 in its thickness direction. The guide parts 15 guide both ends of the substrate 101 in the width direction and thickness directions relative to the housing 11.

The housing 11 includes a cap mounting part 17 formed in the end surface on the side of the substrate 101 and extending longitudinally. The cap mounting part 17 is a groove-like concave portion formed outside the terminal receiving groove 16, and a fitting projection 22 of the preload cap 21, (described later) is inserted in the cap mounting part 17.

As illustrated in FIG. 4, the terminal 51 has a contact portion 52 integrally connected to the lower end of the terminal body, which extends linearly in the vertical direction and is fixed to the terminal receiving groove 16. It includes a counterpart contact portion 53 integrally connected to the upper end of the terminal body and contacts a counterpart terminal 254 of a mating connector 201 in the fitting concave portion 13. The contact portions 52 are arranged in mutually opposing rows as they are in the mating connector contact portions 53.

The counterpart contact portion 53 includes an inclined portion 53*a* and a convex portion 53*b*. The inclined portion 53*a* extends obliquely upward from the upper end of the terminal body toward the center of the housing 11 in the thickness direction. In addition, the convex portion 53*b* is connected to the tip of the inclined portion 53*a* and contacts the counterpart terminal 254 of the counterpart connector 201. When the counterpart connector 201 is fitted in the connector 1, the distance between the convex portions 53*b* on both sides are forcibly spread, and the convex portions 53*b* press the mating terminals 254 by an urging force generated due to resilient deformation mainly of the inclined portion 53*a* and the connection portion of the terminal body and the inclined portion 53*a*.

The contact portion 52 has, as a whole, a mountain shape or a shape with a central peak and gentle slopes, with a first inclined portion 52*a*, a convex portion 52*b*, a second inclined portion 52*c*, and an engaging portion 52*d*. The first inclined portion 52*a* extends obliquely downward from the lower end of the body toward the center of the housing 11 in the thickness direction. The second inclined portion 52*c* is connected to the tip of the first inclined portion 52*a* and inclined in a reverse direction to that of the first inclined portion 52*a*. The convex portion 52*b* is a connecting portion of the first inclined portion 52*a* and the second inclined portion 52*c*, and in the illustrated embodiment, it is a portion bent approximately at 90 degrees and contacting the connecting electrode 151 of the substrate 101. In addition, the engaging portion 52*d* is connected to the tip of the second inclined portion 52*c*, extends nearly parallel to the terminal body in the initial state, and engages with a terminal holding portion 24 of the preload cap 21.

As illustrated in the Figures, the distance between the opposing convex portions 52*b* of the terminals are forcibly spread in the state in which the connector 1 is mounted on the substrate 101, and the convex portions 52*b* presses the connecting electrodes 151 by the urging force generated due to the resilient deformation mainly of the first inclined portions 52*a* and the connection portions of the terminal bodies and the first inclined portions 52*a*. Thereby, the connecting state of the terminals 51 to the connecting electrodes 151 is reliably maintained. In addition, the state in which the connector 1 is mounted on the substrate 101 is maintained when the substrate 101 is sandwiched by the opposing contact portions 52. In addition, the terminals 51 and the connecting electrodes 151 can be secured by a securing means such as soldering, or the like. In this case, the electrical connecting state of the terminals 51 to the connecting electrodes 151 can be reliably maintained and the mounting state of the connector 1 on the substrate 101 can be more reliably maintained.

Next, the structure of the preload cap 21 will be explained.

Figure 5:
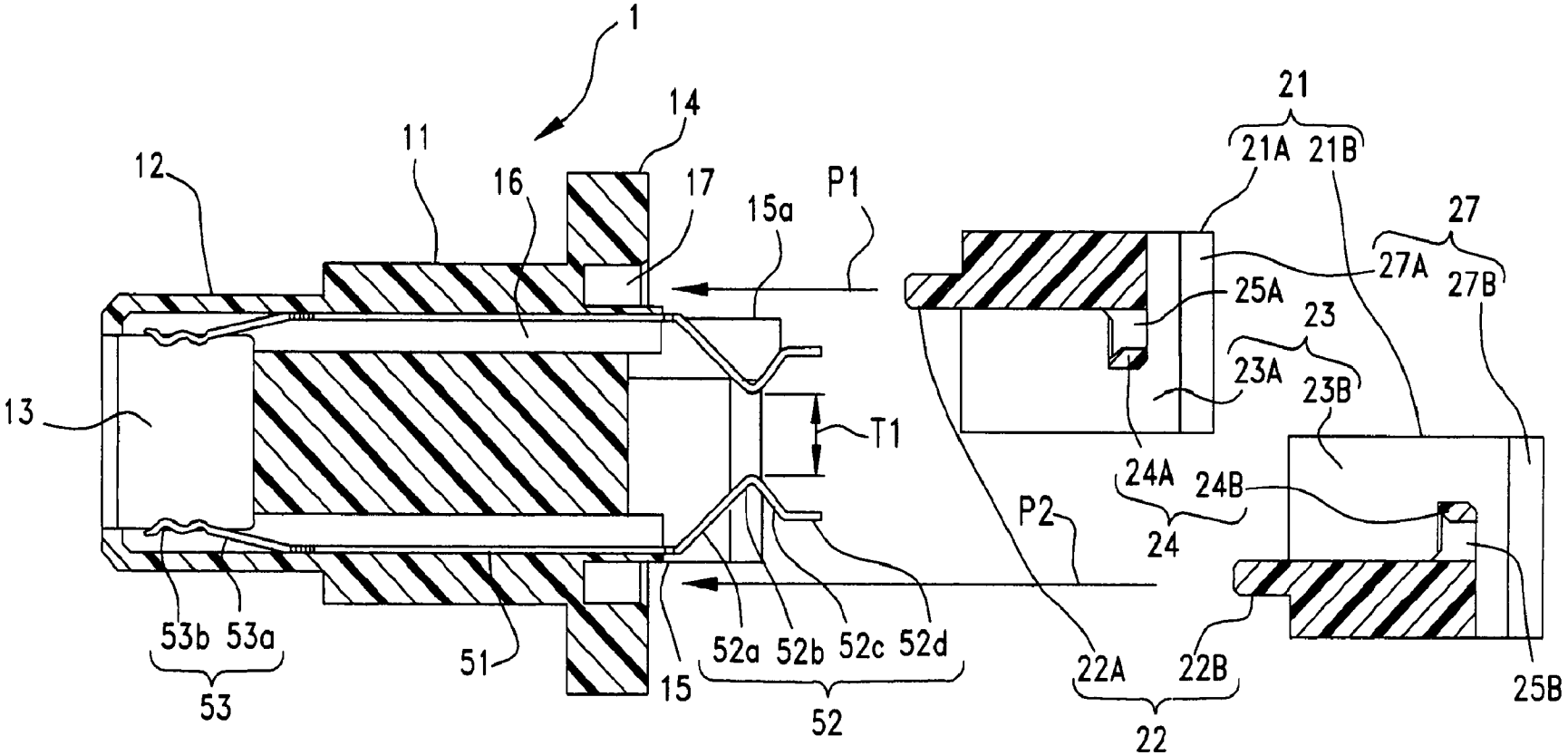
FIG. 5 is a cross-sectional exploded view illustrating the edge connector before the preload cap is attached thereto.
Figure 7:
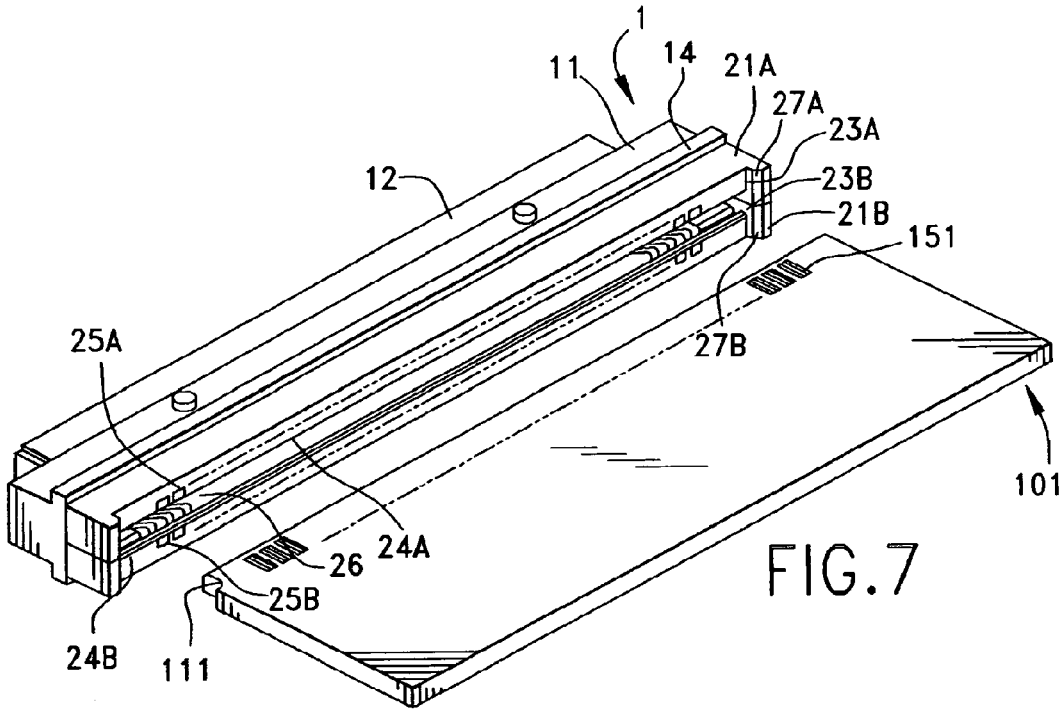
FIG. 7 is a perspective view illustrating the edge connector in with the preload caps attached thereto.
Figure 8:
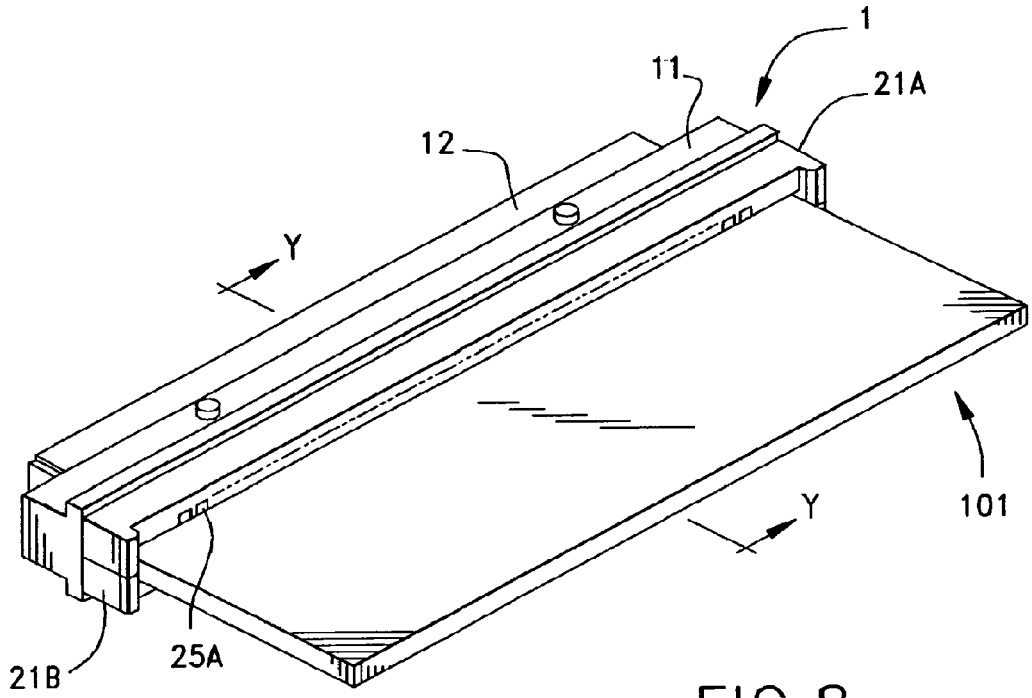
FIG. 8 is the same view as FIG. 7, but illustrating the edge connector with the substrate is inserted into the preload cap.

As illustrated in FIGS. 5, 7 & 8, a first preload cap 21A and a second preload cap 21B are mounted on the connector 1. The first preload cap 21A and the second preload cap 21B have an identical structure, and members belonging to the first preload cap 21A are allocated a designation of "the first" and appended with the letter "A", and members belonging to the second preload cap 21B are allocated a designation of "the second" and appended with the letter "B" for differentiation. It is to be noted that when explanation is made without differentiating the members belonging to the first preload cap 21A from those of the second preload cap 21B, the designation of "the first" and "the second" and the letters "A" and "B" will be omitted.

Figure 6:
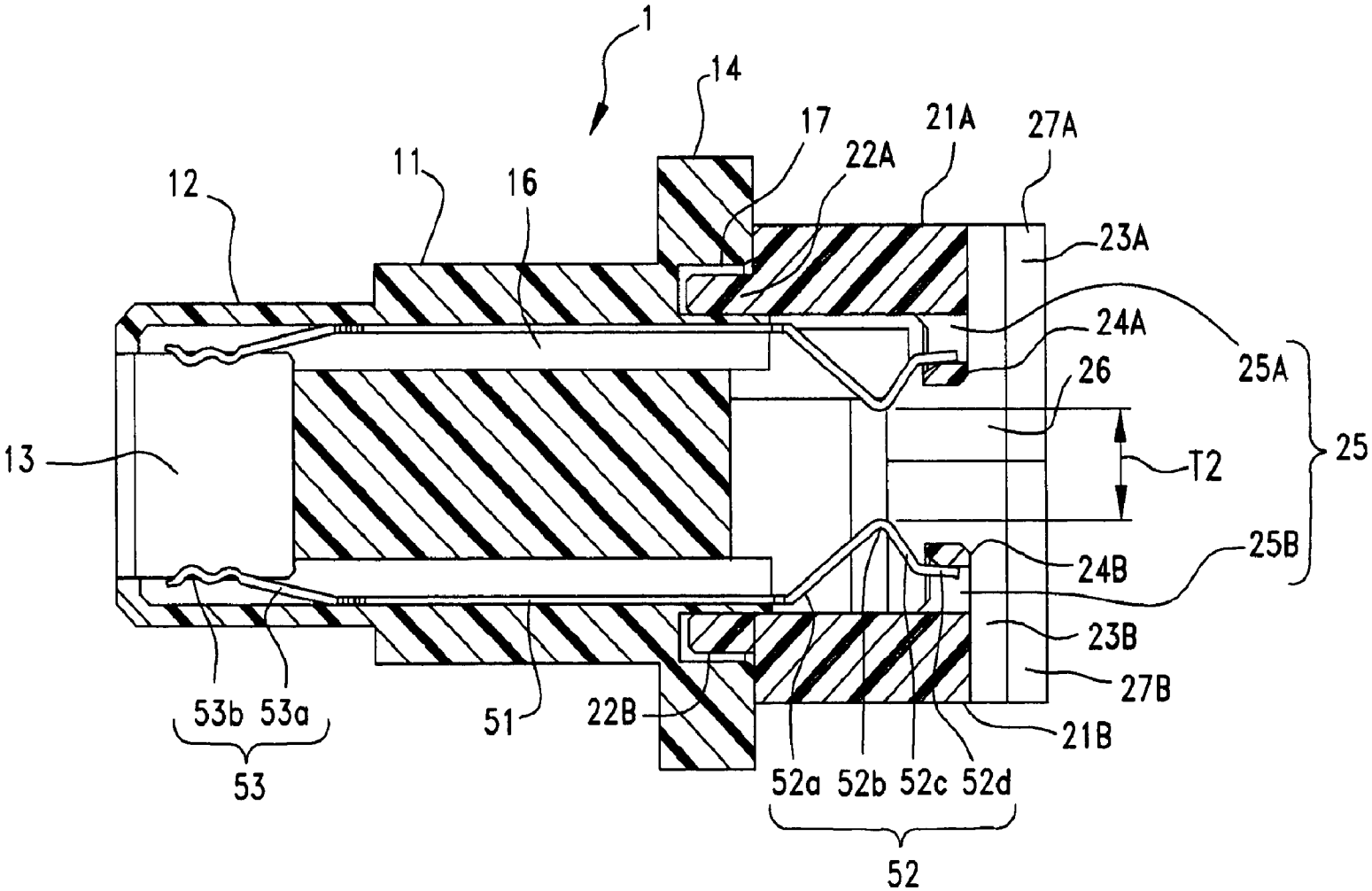
FIG. 6 is the same view as FIG. 5, but illustrating the edge connector after the preload cap is attached thereto.

The preload cap 21A and the preload cap 21B include elongated rectangular bodies extending longitudinally of the housing 11, and first end wall portions 23A and second end wall portions 23B extending perpendicularly to the bodies are connected to opposite longitudinal ends of the bodies. As illustrated in FIG. 6, the first preload cap 21A and the second preload cap 21B form a rectangular tube having an elongated rectangular cross-section extending longitudinally along the housing 11. The first preload cap 21A and the second preload cap 21B are arranged to face each other. When the first preload cap 21A and the second preload cap 21B are mounted on the connector 1, the bodies which form a pair of elongated side walls cover the outside of the contact portions 52 of the terminals 51. The end wall portions 23 form a pair of short side walls and cover the outside of the guide parts 15 on opposite ends. An elongated rectangular substrate insertion opening 26 is formed between the first preload cap 21A and the second preload cap 21B. Inclined surfaces 27 for guiding the end of the substrate 101 into the substrate insertion opening 26 are formed on the inside ends of the end wall portions 23 on the opposite side of the connector 1 (left side of FIGS. 5-6).

The length of the preload cap 21 is longer than the amount of extension of the contact portion 52 of the terminal 51 from the end surface of the housing 11 so that the terminal contact portion 52 are protected by the preload cap 21 and are not be damaged by the contact with fingers of an operator, tools, other peripheral devices, or the like.

In addition, the preload cap 21 includes a fitting projection 22 integrally formed therewith so that it projects from the end surface of the body on the side of the connector 1 toward the connector 1 and extends longitudinally of the body. The preload cap 21 is attached to the housing 11 of the connector 1 when the fitting projection 22 is inserted in the cap mounting part 17 of the housing 11.

The preload cap 21 also includes a terminal holding portion 24 integrally formed therewith that projects from the inner end of the body on the opposite side of the connector 1 and extends longitudinally of the body. The terminal holding portion 24 has a terminal insertion hole 25 formed therein which extends through the terminal holding portion 24. When the preload cap 21 is attached to the connector 1, the engaging portions 52*d* of the contact portions 52 of the terminals 51 are inserted in the terminal insertion hole 25 and secured by the terminal holding portion 24. The amount of extension of the terminal holding portion 24 toward the center in the thickness direction is set such that the distance between the convex portions 52 of the contact portions 52 on opposite sides becomes a value T2 which is slightly greater than a value T1 in the initial state as illustrated in FIG. 5.

The distance between the first terminal holding portion 24A and the second terminal holding portion 24B is set to be greater than the value tx of thickness of the substrate 101, which will be described later. Thereby, since the size of the substrate insertion opening 26 in the thickness direction becomes greater than the value tx of the thickness of the substrate 101, the substrate 101 can be easily inserted therein.

The first preload cap 21A and the second preload cap 21B can be separately and sequentially attached to the connector 1, as illustrated in FIG. 5. An operator relatively moves the first preload cap 21A toward the connector 1, as indicated by arrow P1 of FIG. 5. The operator may insert the first fitting projection 22A in the upper cap mounting part 17 of the housing 11, and insert the engaging portions 52*d* of the upper terminals 51 into the first terminal insertion hole 25A so that the engaging portions 52*d* engage with the first terminal holding portion 24A. Subsequently, the operator holds the second preload cap 21B with hands or fingers and moves it toward the connector 1, as indicated by the arrow P2. The operator may then insert the second fitting projection 22B in the lower cap mounting part 17 of the housing 11, and insert the engaging portions 52*d* of the lower terminals 51 into the second terminal insertion hole 25B so that the engaging portions 52*d* engage the second terminal holding portion 24B.

As illustrated in FIG. 6, the preload cap 21 is attached to the connector 1. The engaging portions 52*d* are engaged with the terminal holding portion 24 and the opposing convex portions 52*b* are spread so that the distance therebetween becomes the value T2 which is slightly greater than the value T1 in the initial state. The opposing engaging portions 52*d* sandwich the first terminal holding portion 24A and the second terminal holding portion 24B by an urging force generated due to a resilient deformation of the first inclined portions 52*a* and the connection portions of the terminal bodies and the first inclined portions 52*a*. Accordingly, the attachment of the preload cap 21 to the connector 1 is reliably maintained by the urging force generated by the terminals 51.

In addition, when viewed from the side of the terminals 51, a load that can resiliently deform mainly the first inclined portions 52*a* and the connection portions of the terminal bodies and the first inclined portions 52*a* is given to the terminals 51 as a pre-load pressure, that is, a preload when the engaging portions 52*d* are engaged with the terminal holding portion 24. In this case, the distance T2 between the opposing convex portions 52*b* is set to be smaller than the value tx of the thickness of the substrate 101. Therefore, since the amount of deformation of the terminals 51 is small in the state when the preload cap 21 is attached and the preload is given to the terminal 51, a creep deformation will not occur in the terminals 51 even when the connector is left to stand for a long period of time. Accordingly, as described above, a creep deformation may not occur in the terminals 51 and the terminals 51 can maintain a sufficient elastic force even when the connector 1 is stored for a long period of time in the state in which the preload cap 21 is attached thereto.

The operator relatively moves the substrate 101 and inserts the edge portion of the substrate 101 on the side in which the contact pods 151 of the substrate 101 are disposed into the rectangular tube having the elongated rectangular cross-section formed by the first second preload caps 21A 21B facing each other. In FIG. 7, a rectangular cutaway portion 111 is formed in one end of the edge portion of the substrate 101. The cutaway portion 111 abuts against the edge of the guide part 15 of the housing 11 and defines the length of insertion of the substrate 101 in between the terminals 51. It is to be noted that the cut-away portion 111 may be formed in both ends of the edge portion of the substrate 101, or may be omitted.

In this case, since the both ends of the edge portion of the substrate 101 are guided by the inclined surfaces 27 formed in the end wall portions 23 of the preload cap 21, the edge portion of the substrate 101 can be easily inserted. When the substrate 101 is further moved into the connector 1, both ends of the edge portion of the substrate 101 will be guided by the first extension portion 15*a* and the second extension portion 15*b* of the guide part 15 of the housing 11. Thus the positional relationship relative to the housing 11 in the width and thickness directions of the substrate 101 are defined, and the connecting electrodes 151 exposed to opposite surfaces of the edge portion of the substrate 101 are reliably set at the position facing the contact portions 52 of the corresponding terminals 51.

Figure 9:
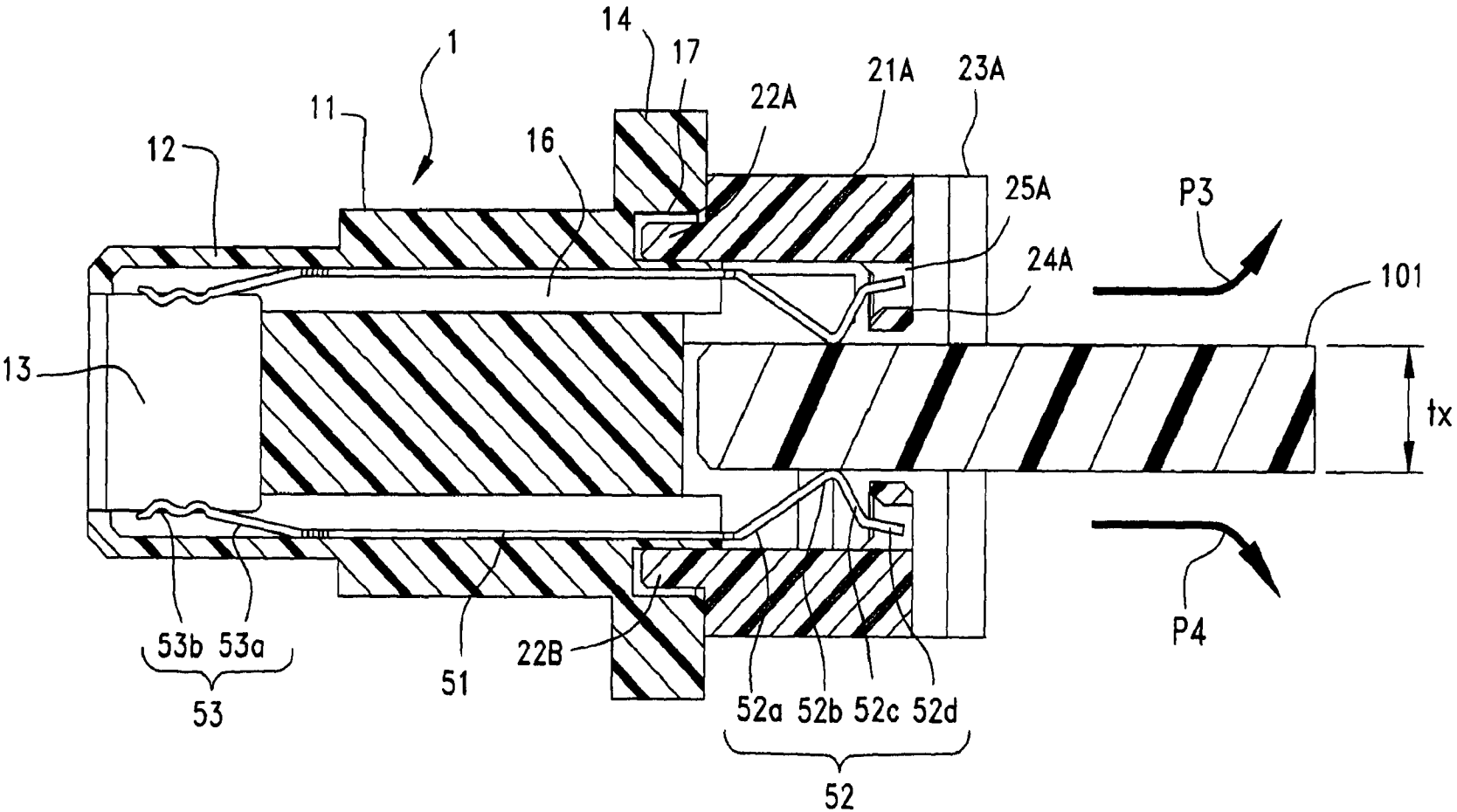
FIG. 9 is a cross-sectional view taken along line Y-Y of FIG. 8, illustrating the edge connector with the substrate is inserted and the preload caps attached thereto.

When the substrate 101 is completed by inserted as shown in FIG. 9, it enters between the terminal contact portions 52 and forcibly spreads the convex portions 52*b* of the contact portions 52 apart. When the engaging portion 52*d* is engaged by the terminal holding portion 24, the distance T2 of the convex portions 52*b* on opposite sides is smaller than the value tx of thickness of the substrate 101, the distance between the convex portions 52*b* is forcibly spread by the substrate 101, and the engaging portions 52*d* are in the state of being separated from the terminal holding portions 24.

In addition, since the size of the substrate insertion opening 26 in the thickness direction is set to be greater than the value tx of the thickness of the substrate 101, the substrate 101 can be inserted therein without contacting the terminal holding portion 24.

The substrate 101 enters between the opposing contact portions 52 when the distance between the convex portions 52*b* of the contact portions 52 at T2 (which is greater than T1 in the initial state) that is, in the state in which preload is given to the terminals 51, the resistance incurred by the substrate 101 from the terminals 51 decreases as compared to that when the substrate 101 enters between the contact portions 52 in the initial state. The insertion of the substrate 101 is easily performed. The resistance received by the substrate 101 from the terminals 51 is small and the substrate 101 will not be damaged. Likewise the reaction force received by the terminals 51 from the substrate 101 is small and the terminals 51 may will not be deformed or be damaged.

The contact pods 151 move relative to the convex portions 52*b* when the convex portions are pressed against the contact pods 151 by an urging force generated due to the resilient deformation of the terminals 51 when the substrate 101 enters between the contact portions 52. The wiping effect is generated when the convex portions 52*b* contact the moving contact pods 151 in the state of being pressed and dust, foreign matters, or the like, is removed by being rubbed by the convex portion 52*b*. Likewise, the dust, foreign matters, or the like of the convex portion 52*b* may be removed when being rubbed by the contact pods 151.

The convex portions 52*b* press the pods 151 by an urging force and the electrical connecting state of the terminals 51 and the pods 151 is reliably maintained. Creep deformation will not occur in the terminal 51 and since the terminals 51 maintain a sufficient elastic force, the urging force is large enough. Accordingly, the terminal convex portions 52*b* press the contact pods electrodes 151 with a sufficiently large force and the contact portions 52 on opposite sides sandwich the substrate 101 with a sufficiently large force.

Figure 10:
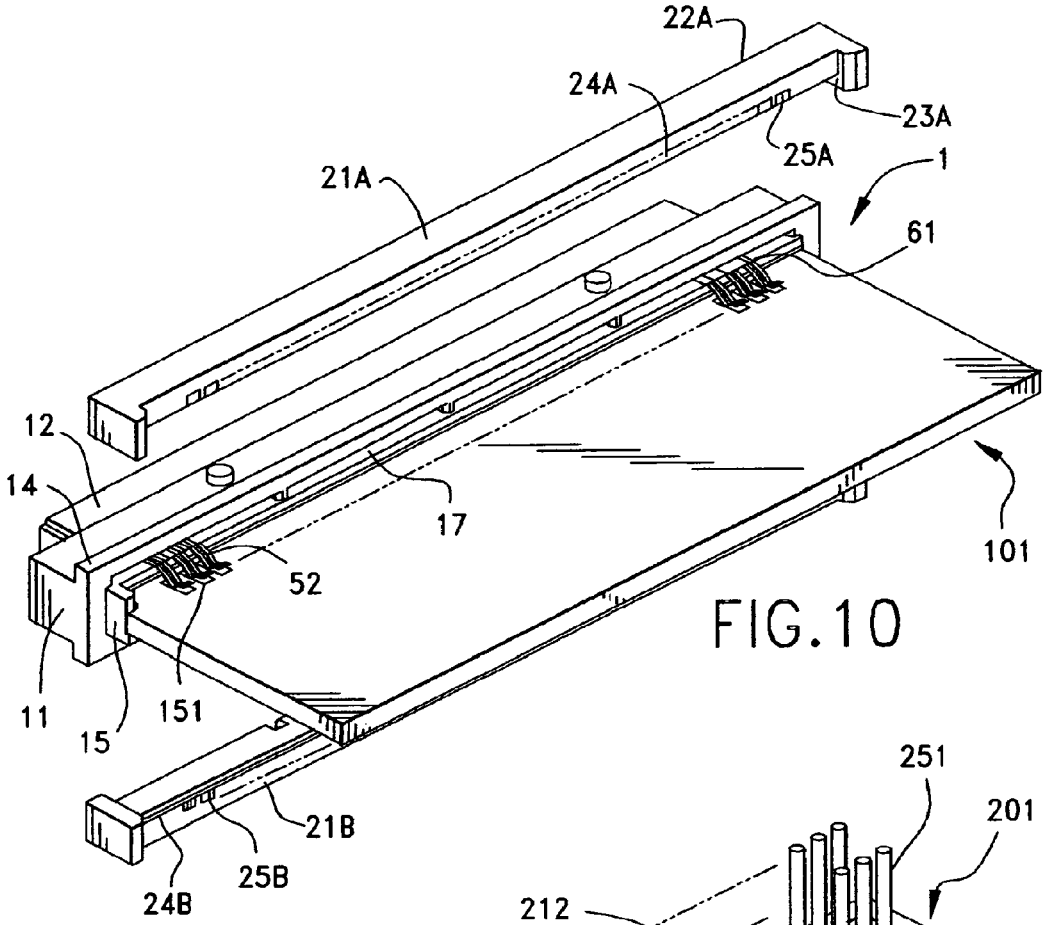
FIG. 10 is a perspective view illustrating the edge connector with the preload caps removed therefrom.

Subsequently, the operator removes the preload cap 21 from the connector 1. The operator removes the first preload cap 21A from the connector 1, as indicated by the arrow P3, and further relatively removes the second preload cap 21B from to the connector 1, as indicated by the arrow P4. Since the distance between the convex portions 52*b* is then spread and the engaging portions 52*d* are separated from the terminal holding portions 24, the urging force generated by the terminals 51 does not act on the preload cap 21, and therefore the preload cap 21 is freely movable. The preload cap 21 is then easily removed from the connector 1. (FIG. 10)

In the case of securing the terminals 51 and the connecting electrodes 151 by soldering, a solder layer is formed in the surface of the contact pods 151 in advance. The preload cap 21 is removed from the connector 1 and the solder is reflowed by accommodating the connector 1 and substrate 101 in a furnace. Thereby, the connecting state of the terminals 51 and the substrate 101 to the contract pods 151 is reliably maintained.

Figure 12:
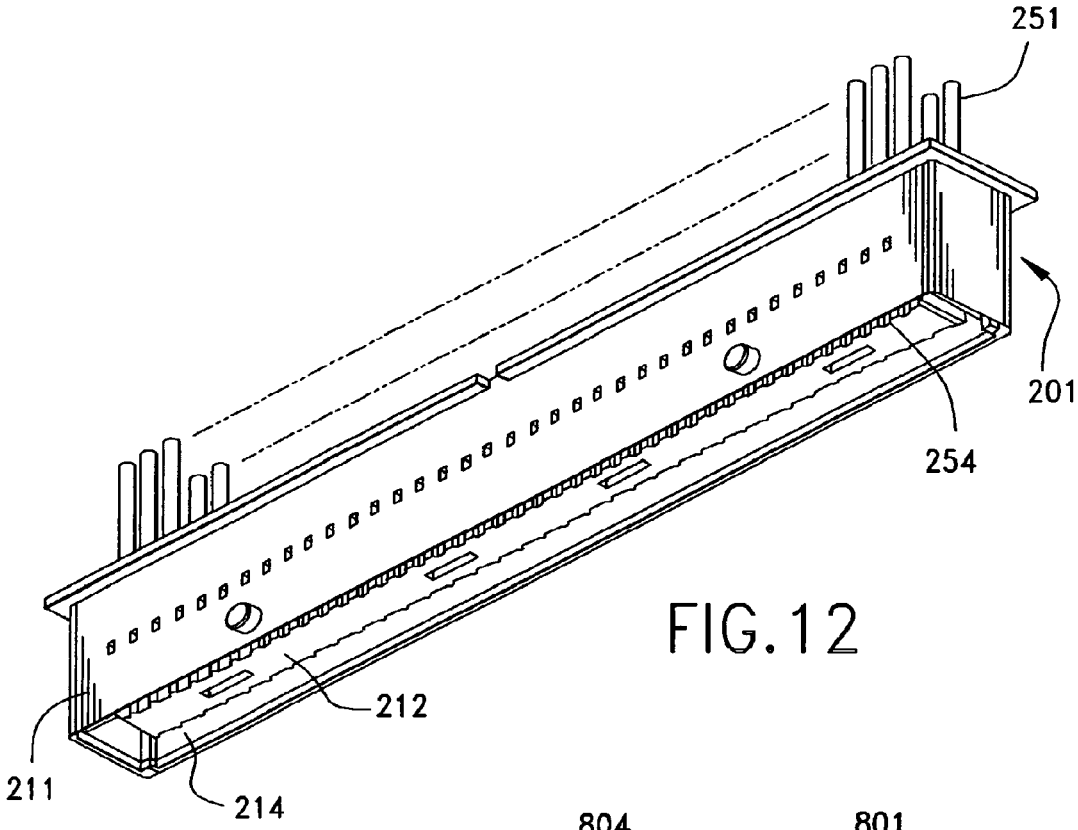
FIG. 12 is a second perspective view illustrating the opposing end of the counterpart connector of FIG. 11, to the embodiment of the present invention.
Figure 14:
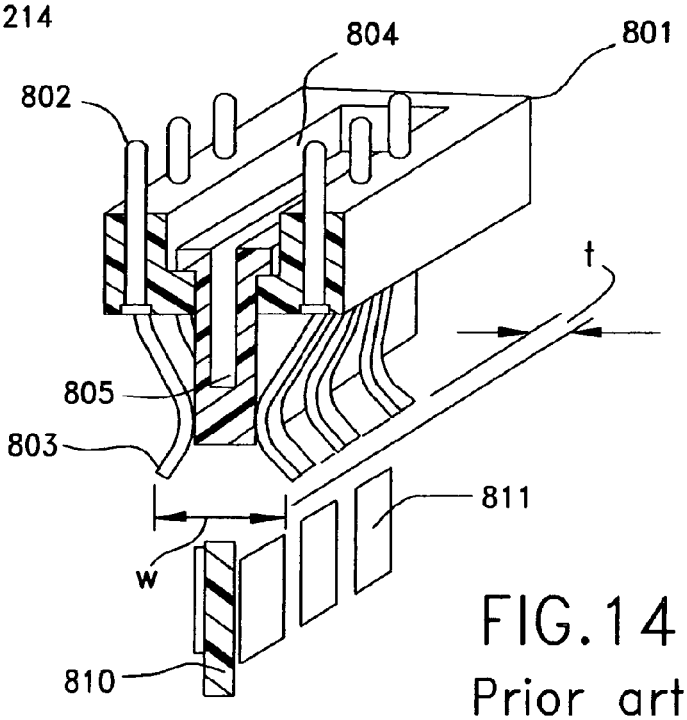
FIG. 14 Prior art
FIG. 14 is a perspective view illustrating a conventional edge connector.
Figure 13:
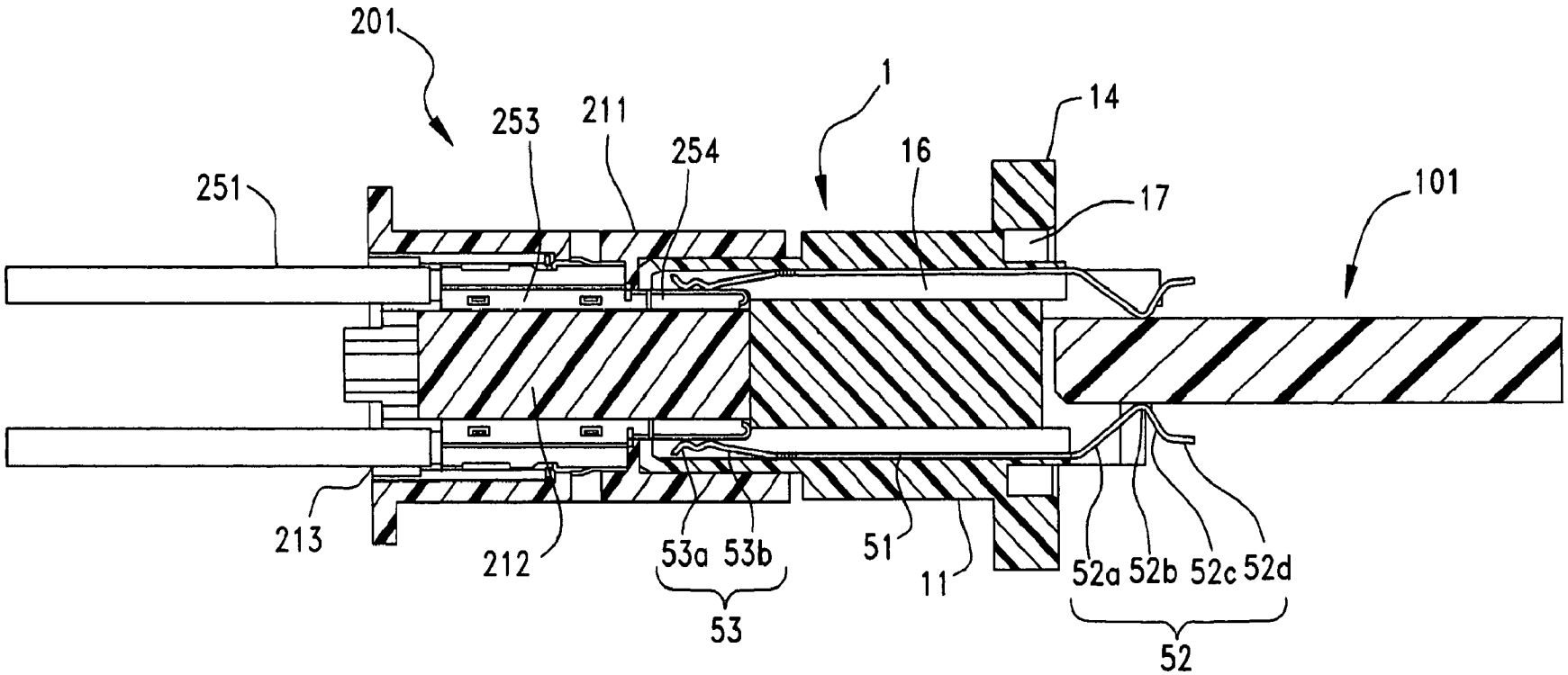
FIG. 13 is a cross-sectional view illustrating the edge connector of the present invention mated to the counterpart connector.

The counterpart connector 201 includes a counterpart housing 211 made of an insulating material and a plurality of conductive terminals 254 which are fitted in the counterpart housing 211. The counterpart housing 211 is also an elongated member and as illustrated in FIG. 12, a fitting opening 214 is formed in the fitting surface and includes a convex portion 212 disposed in the opening 214. As illustrated in FIG. 13, the fitting portion 12 of the connector 1 is fitted in the opening 214 and the convex portion 212 is fitted in the fitting portion 12 when the connector 1 and the counterpart connector 201 are mated together.

Figure 11:
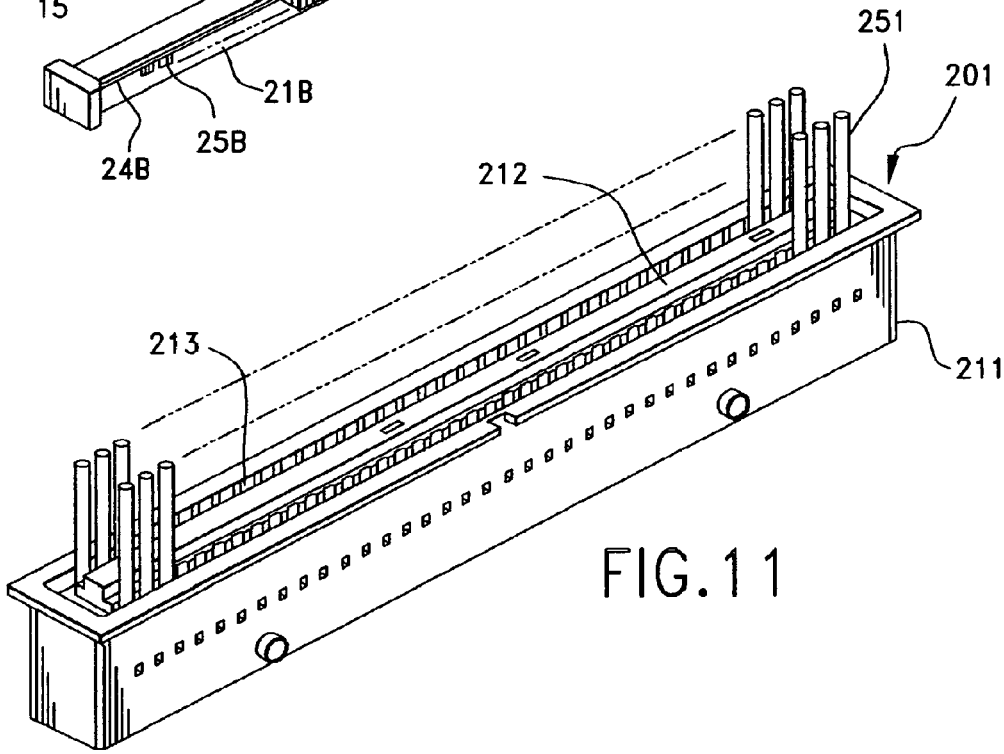
FIG. 11 is a first perspective view illustrating a counterpart connector of the edge connectors of the present invention.

The counterpart housing 211 includes wire insertion openings 213 that open to the surface on the opposite side of the fitting surface (upper surface in FIG. 11). Tips of wires 251 such as coaxial cables, or the like, are accommodated in these openings 213. The wire terminals 253 are connected to the tips of the wires 251 and the terminals 253 are engaged in the insertion openings 213. The wire terminals 253 are connected to the corresponding counterpart terminals 254, and thus, each of the wires 251 is connected to a counterpart terminal 254.

When the connector 1 and the counterpart connector 201 are mated together, the convex portion 212 enters between the contact portions 53 on the opposite sides. The distance between the convex portions 53*b* on the opposite sides is spread apart and the convex portions 53*b* press the counterpart terminals 254 by the urging force generated due to a resilient deformation of the inclined portions 53*a* and the connection portions of the connector bodies. The connection of the terminals 51 and counterpart terminals 254 is reliably maintained. When the counterpart contact portions on the opposite sides sandwich the convex portions 212, the mating state of the connector 1 and the counterpart connector 201 is reliably maintained.

In addition, the wires 251 such as coaxial cables, or the like, are not necessarily be connected to the counterpart connector 201, and for instance, a flat cable such as an FPC, an FFC, or the like, may be connected thereto.

The housing 11 of the connector 1 includes a cap mounting part 17 for attaching the preload cap 21 and the contact portions of the terminals 51 are arranged in opposing rows, and the distance between the opposing contact portions 52 in the initial state is smaller than the thickness of the substrate 101, while the distance in a state in which the preload cap 21 is attached is larger than that in the initial state and smaller than the thickness of the substrate 101.

The preload given to the terminals 51 may be maintained to an appropriate amount so that creep deformation will not occur in the terminals 51 even when the connector is left to stand for a long period of time, such as in inventory. Accordingly, the terminals 51 will always a force sufficient to sandwich the substrate 101. The resistance received by the substrate 101 during an insertion is reduced and the insertion is easily performed, and a deformation or damage may not occur in the terminals 51. Further, the electrical connecting state of the contact portions 52 of the terminals 51 and the connecting electrodes 151 becomes favorable due to the wiping effect.

In addition, the contact portion 52 includes the engaging portion 52*d* at the tip thereof, the preload cap 21 includes the terminal holding portion 24, and the engaging portion 52*d* is engaged with the terminal holding portion 24 in the state in which the preload cap 21 is attached. Thereby, a preload is given to the terminals 51 and the terminals 51 can resiliently and elastically deform. In addition fitting of the preload cap 21 to the connector 1 may be reliably maintained by the urging force generated by the terminals 51.

The preload cap 21 includes the first preload cap 21A and the second preload cap 21B, both of which are preferably identical to each other and are attached to the housing 11 so they face each other. Accordingly, the structure of the preload cap 21 is simplified and the preload cap 21 may be manufactured at a low cost. The first preload cap 21A and the second preload cap 21B form what may be considered as a tube for covering the outside of the opposing rows of the contact portions 52. The length of the preload cap 21 away from the housing 11 is greater than the length the terminal contact portions 52 external from the housing 11. Thus the contact portions 52 of the terminals 51 are protected by the preload cap 21 and are not be damaged by contact with fingers of an operator, tools or the like.

The preload cap 21 forms the substrate insertion opening 26 into which the substrate 101 can be inserted in the state in which the preload cap 21 is attached to the housing 11, and the preload cap 21 can be removed from the housing 11 when the substrate 101 is inserted in the substrate insertion opening 26 and the distance between the opposing contact portions 52 is spread by the insertion of the substrate 101. Thereby, the insertion work of the substrate 101 and the fitting operation of the preload cap 21 may be easily performed.

The present invention is not limited to the above-described embodiments, and may be changed in various ways based on the gist of the present invention, and these changes are not eliminated from the scope of the present invention.

The invention claimed is:

1. An edge connector comprising:

a connector body for mating with an opposing connector;

terminals extending from the connector body, the terminals including contact portions for contacting with conductive pods disposed on opposite surfaces of a substrate;

wherein:

the connector body comprises a mounting part for engaging a removable preload cap;

the contact portions are arranged in opposing rows; and a distance between the opposing contact portions in a first state is smaller than a thickness of the substance, and the distance in a second state wherein the preload cap is attached to the connector body is larger than the initial state and smaller than the thickness of the substrate.

2. The edge connector according to claim 1, wherein:

each contact portion comprises an engaging portion at a tip thereof;

the preload cap comprises a terminal holding portion; and each engaging portion engages the terminal holding portion where the preload cap is attached to the connector body.

3. The edge connector according to claim 1, wherein:

the preload cap comprises a first preload cap part corresponding to one of the rows of the contact portions and a second preload cap part corresponding to the other row of the contact portions; and the first preload cap and second preload cap are identical, and are attached to the connector body facing each other.

4. The edge connector (1) according to claim 3, wherein the first preload cap and second preload cap form a tube covering the opposing rows of the contact portions.

5. The edge connector according to claim 1, wherein the preload cap, when attached to the connector body, extends longer from the connector body than the terminal contact portions extend from the connector body.

6. The edge connector according to claim 1, wherein:

the mounting part comprises a concave portion formed in the connector body; and the preload cap comprises a fitting projection attached to the connector body.

7. The edge connector according to claim 1, wherein:

the preload cap defines a substrate insertion opening into which the substrate can be inserted when the preload cap is attached to the connector body, and the preload cap can be removed from the connector body after the substrate is inserted into the substrate insertion opening; and the distance between opposing contact portions is spread apart by insertion of the substrate into the insertion opening.

8. The edge connector of claim 7, wherein the substrate insertion opening is concave.

* * * * *